United States Patent [19]

Yamada et al.

[11] Patent Number: 4,985,155

[45] Date of Patent: Jan. 15, 1991

[54] SILICONE-CONTAINING FABRIC FINISHING AGENT

[75] Inventors: Koichiro Yamada, Fukui; Masaki Tanaka, Gunma; Toshio Ohba, Gunma; Hiroshi Ohashi, Gunma, all of Japan

[73] Assignee: Nissin Chemical Industry Co., Ltd., Takefu, Japan

[21] Appl. No.: 324,070

[22] Filed: Mar. 16, 1989

[30] Foreign Application Priority Data

Mar. 17, 1988 [JP] Japan ..... 63-64396

[51] Int. Cl.[5] ..... D06M 15/00

[52] U.S. Cl. ..... 252/8.6; 8/DIG. 1

[58] Field of Search ..... 252/8.6; 8/DIG. 1, 581; 524/588

[56] References Cited

U.S. PATENT DOCUMENTS 3,624,015 11/1971 Vaughn et al. ..... 260/827

FOREIGN PATENT DOCUMENTS 48-102188 12/1973 Japan .

OTHER PUBLICATIONS

Abstract of JP 48-102188.
Abstract of JP 60-88040.
Abstract of JP 61-106614.
Abstract of JP 61-136510.

*Primary Examiner*—Paul Lieberman
*Assistant Examiner*—John F. McNally
*Attorney, Agent, or Firm*—Millen, White & Zelano

[57] ABSTRACT

The fabric finishing agent is a solution of a graft copolymer composed of an organopolysiloxane moiety and a grafting moiety thereon obtained by the graft copolymerization of an acrylic or methacrylic monomer, optionally, in combination with monomers of other types. The fabric finishing agent is capable of imparting various kinds of fabric materials with greatly improved soft but non-sticky feeling of touch with resilient elasticity and the effect of treatment is durable and resistant against laundering and dry cleaning.

11 Claims, No Drawings

SILICONE-CONTAINING FABRIC FINISHING AGENT

BACKGROUND OF THE INVENTION

The present invention relates to a fabric finishing agent or, more particularly, to a silicone-containing fabric finishing agent capable of imparting a fabric material with water-repellency and a feeling of softness and highly resilient elasticity and having excellent durability and launderability.

Various types of fabric finishing agents are known and widely used in the fabric industry in the form of a solution in an organic solvent of a resin such as silicones, polyurethanes, polyacrylates and the like. These fabric finishing agents must be capable of imparting treated fabric material with a soft but non-sticky feeling with resilient elasticity, high waterproofness and moisture permeability and resistance against laundering and dry cleaning as well as good workability in sewing. It is also required that the fabric material can be treated with the fabric finishing agent repeatedly in the fabric finishing process.

Conventional fabric finishing agents, however, each have their own advantages and disadvantages and none of them alone can satisfy all of the above-mentioned requirements simultaneously. For example, silicone-based fabric finishing agents have defects with respect to poor waterproofness and low launderability of the cloths treated therewith due to the low strength of the coating film formed on the fiber surface although they are generally satisfactory with respect to the softness, resilient elasticity, non-stickiness, moisture permeability, water repellency and weatherability of the treated cloths. Polyurethane-based fabric finishing agents are advantageous in the high strength of the coating film formed on the fiber surface to give excellent waterproofness and launderability of the treated cloths but the fabric material treated therewith has a stiff feeling and improvement in the fastness and water-repellency of the treated cloth cannot be expected. Polyacrylate-based fabric finishing agents are disadvantageous with respect to softness of feeling and water-repellency of the treated material similarly to the polyurethane-based ones although they are generally satisfactory with respect to waterproofness, seam strength against fatigue, color fastness and resistance against laundering and dry cleaning.

In view of the above mentioned problems, proposals have been made to use fabric finishing agents of different types in combination. None of the possible combinations, however, can give fully satisfactory results with respect to satisfying all of the above mentioned requirements simultaneously due to the incompatibility of resins of different types. For example, silicones and polyacrylates are quite different polymers so that combined use of a silicone-based fabric finishing agent and an polyacrylate-based fabric finishing agent gives a coating film on the fiber surface which is a microscopically inhomogeneous composite of the polymers, probably due to phase separation.

SUMMARY OF THE INVENTION

The fabric finishing agent of the present invention was developed with an object to solve the above-described problems and disadvantages in the conventional fabric finishing agents and is a composition in the form of a solution in:

(A) available inert organic solvent of;

(B) a graft copolymer product of a graft copolymerization of (a) from 5 to 95 parts by weight of an organopolysiloxane represented by the general formula $$XO\text{-}1\,(-SiR_2-O-)_m-(-SiYR-O-)_n-X, \qquad (I)$$

in which each R is a substituted or unsubstituted monovalent hydrocarbon group of 1 to 20 carbon atoms, Y is a monovalent radical-polymerizable group or a monovalent organic group having a mercapto —SH group, X is a hydrogen atom, lower alkyl group or a triorganosilyl group of the formula $R_2R^1Si$—, R having the same meaning as defined above and $R^1$ being R or Y, m is a positive integer not exceeding 10,000 and n is a positive integer, and from 95 to 5 parts by weight of (b) an acrylic or methacrylic monomer represented by the general formula $$CH_2{=}CR^2{-}CO{-}OR^3, \qquad (II)$$

in which $R^2$ is a hydrogen atom or a methyl group and $R^3$ is an alkyl group or an alkoxy-substituted alkyl group having 1 to 18 carbon atoms alone or as a mixture of monomers (b-1) at least 70% by weight of which is an acrylic or methacrylic monomer (b) as defined above, and one or both of (b-2) up to 30% by weight of which is an ethylenically unsaturated monomer containing one and only one radical-polymerizable ethylenically unsaturated group and at least one functional group in the molecule selected from the group consisting of hydroxy, hydroxy-terminated polyoxyalkylene, carboxyl, oxirane, amido, N-alkylolamido, N-(alkoxyalkyl)amido and amino groups, and (b-3) up to 20% by weight of which is another radical polymerizable ethylenically unsaturated monomer different from monomers (b-1) and (b-2) defined above, in the presence of a radical polymerization initiator and dissolved in component (A).

DETAILED DESCRIPTION OF THE PREFERRED EMBODIMENTS

As is described above, the fabric finishing agent of the present invention is a solution of a copolymeric resin as the component (B) dissolved in an organic solvent as the component (A), which copolymeric resin is a graft copolymer obtained by the graft copolymerization of the organopolysiloxane as the reactant (a) and a (meth-)acrylic monomer as the reactant (b-1) optionally combined with other monomers (b-2) and/or (b-3) in the presence of a radical polymerization initiator.

The component (a) employed in the graft copolymerization to give the graft copolymer (b) as the principal ingredient of the inventive fabric finishing agent is an organopolysiloxane represented by the above given general formula (I). In the formula, each of the groups denoted by R is a monovalent hydrocarbon group having 1 to 20 carbon atoms exemplified by alkyl groups, e.g., methyl, ethyl, propyl and butyl groups, cycloalkyl groups, e.g., cyclohexyl group, and aryl groups, e.g., phenyl, tolyl, xylyl and naphthyl groups, or a substituted hydrocarbon group obtained by replacing a part or all of the hydrogen atoms in the above named hydrocarbon groups with halogen atoms, cyano groups and the like exemplified by chloromethyl, 3,3,3-trifluoropropyl and 2-cyanoethyl groups. Two kinds or more of these groups can be present in a molecule of the organopolysiloxane as the groups denoted by R. The group denoted by Y is a radical-polymerizable group or a mercapto-containing organic group exemplified by vinyl, allyl, 3-acryl-oxypropyl, 3-methacryloxypropyl and 3-mercaptopropyl groups. The group denoted by X is a hydrogen atom, a lower alkyl group having 1 to 5 carbon atoms such as methyl, ethyl, propyl and butyl groups or a triorganosilyl group of the formula $R_2R^1Si$—, in which R has the same meaning as defined above and $R^1$ is R or Y defined above. The subscript m is a positive integer not exceeding 10,000 or, preferably, in the range from 500 to 8000 and the subscript n is a positive integer, preferably, not exceeding 300. The group denoted by R is preferably a methyl group.

Such an organopolysiloxane can be prepared by a method well known in the art of silicones. Assuming that the group denoted by R is a methyl group, namely, the organopolysiloxane is prepared, for example, by the siloxane rearrangement equilibration reaction between a dimethylpolysiloxane, which may be a cyclic dimethyl siloxane oligomer or a linear dimethylpolysiloxane terminated at the molecular chain ends with silanolic hydroxy groups, alkoxy, e.g., methoxy and ethoxy, groups or trimethyl siloxy groups, and a Y-containing alkoxy silane such as methyl dimethoxy silane of the formula $(CH_3O)_2(CH_3)SiY$ and, methyl diethoxy silane of the formula $(C_2H_5O)_2(CH_3)SiY$ in which Y is a group defined above, a cyclic organosiloxane oligomer as a hydrolysis product of the Y-containing silanes in the presence of a strongly alkaline catalyst such as potassium hydroxide, sodium hydroxide, cesium hydroxide, tetramethyl ammonium hydroxide, tetrabutyl phosphonium hydroxide and the like or a strongly acidic catalyst such as sulfuric acid, trifluoromethane sulfonic acid and the like.

The thus obtained organopolysiloxane may be emusified in an aqueous medium by using a suitable surface active agent as an emulsifying agent. Examples of suitable surface active agents include non-ionic surface active agents such as polyoxyethylene alkyl esters, sorbitan fatty acid esters, polyoxyethylene sorbitan fatty acid esters, saccharose fatty acid esters and the like, anionic surface active agents such as sodium lauryl sulfate, sodium polyoxyethylene dodecyl sulfate and the like and cationic surface active agents such as alkyl trimethyl ammonum chloride, alkyl benzyl ammonium chloride, dialkyl dimethyl ammonium chloride and the like.

A method of emulsion polymerization is applicable to the preparation of the organopolysiloxane followed by salting out and washing and drying of the coagulum according to a known procedure. In carrying out the emulsion polymerization, the above mentioned organopolysiloxane oligomer and an organosilane having a radical-polymerizable group or a mercapto-containing organic group or a hydrolysis product thereof are emulsified in an aqueous medium by using a sulfonic acid-type surface active agent such as those expressed by the formulas $C_6H_{13}$-13 Pn—$SO_3H$, $C_8H_{17}$—Pn—$SO_3H$, $C_{10}H_{21}$—Pn—$SO_3H$, $C_{12}H_{25}$—Pn—$SO_3H$,$C_{14}H_{27}$—Pn—$SO_3H$, $C_8H_{17}(OC_2H_4)_2OSO_3H$ and $C_{10}H_{21}(OC_2H_4)_2OSO_3H$, in which Pn is a 1.4-phenylene group, and/or a sulfate ester-type surface active agent such as sodium lauryl sulfate, sodium polyoxyethylene dodecylphenyl sulfate and the like to effect simultaneous emulsification and polymerization. Alternatively, the starting materials are emulsified in an aqueous medium by using a cationic surface active agent such as alkyl trimethyl ammonium chloride, alkyl benzyl ammonium chloride and the like followed by the emulsion polymerization in the presence of a strongly alkaline material such as sodium hydroxide, potassium hydroxide and the like. It is advantageous that the organopolysiloxane is obtained in the form of an aqueous emulsion and the graft copolymerization of the organopolysiloxane and the radical-polymerizable monomer or monomers is carried out by adding the monomer or monomers to the aqueous emulsion of the organopolysiloxane so that the graft copolymerization proceeds as an emulsion polymerization.

The organopolysiloxane should have an adequate value of the average degree of polymerization which is determined by the above mentioned values of the subscripts m and n. When the average degree of polymerization of the organopolysiloxane is too small, the fabric finishing agent prepared therefrom is less effective for imparting the treated fabric material with a feeling of softness and resilient elasticity. When the average degree of polymerization of the organopolysiloxane is too large, on the other hand, the fabric finishing agent in the form of a solution may have a viscosity so high that certain inconveniences are caused in the use thereof. When the organopolysiloxane is prepared by the emulsion polymerization as mentioned above, the average degree of polymerization thereof can be controlled by adequately selecting the temperature in the aging treatment following the polymerization reaction since a lower temperature in the aging treatment has an effect to increase the average degree of polymerization of the organopolysiloxane.

The thus prepared organopolysiloxane is a component to pertain to the graft copolymerization with one or more of radical polymerizable monomers including the above defined components (b-1), (b-2) and (b-3) of which the monomer (b-1) is essential and the other two are optional.

The radical polymerizable ethylenically unsaturated monomer (b-1) is an acrylic or methacrylic ester represented by the above given general formula (II). In the formula, $R^2$ is a hydrogen atom or a methyl group and $R^3$ is an alkyl group or an alkoxy-substituted alkyl group having 1 to 18 carbon atoms exemplified by methyl, ethyl, propyl, butyl, octyl, 2-methoxyethyl and 2-butoxyethyl groups. Examples of the acrylic or methacrylic ester as the monomer (b-1) include methyl (meth)acrylate, ethyl (meth)acrylate, butyl (meth)acrylate, pentyl (meth)acrylate, hexyl (meth)acrylate, 2-ethylhexyl (meth)acrylate, octyl (meth)acrylate, 2-methoxyethyl (meth)acrylate, 2-butoxyethyl (meth)acryl-ate and the like, in which (meth)acrylate means an acrylate or methacrylate. This monomer (b-1) is essential and the amount thereof in the total amount of the three kinds of the monomers (b-1), (b-2) and (b-3) should be at least 70% by weight. When the amount of the monomer (b-1) is too small, no satisfactory results can be obtained by the treatment of a fabric material with the fabric finishing agent prepared from the graft copolymer in respect of the mechanical strength of the coating film on the fiber surface, resistance against ozone and adhesion of the coating film to the fiber surface inherent in acrylic polymers.

The monomer (b-2) is an ethylenically unsaturated monomer containing a radical-polymerizable ethylenically unsaturated group and a functional group mentioned below in a molecule. The functional group here implied is selected from the class consisting of hydroxy, hydroxy-terminated polyoxyalkylene, carboxyl, oxirane, amido, N-alkylolamido, N-(alkoxyalkyl)amido and amino groups. Examples of the monomer in conformity with the definition include 2-hydroxyethyl (meth-)acrylate, 2-hydroxypropyl (meth)acrylate, polyethylene glycol mono(meth)acrylate, polypropylene glycol mono(meth)acrylate, (meth)acrylic acid, crotonic acid, half esters of maleic acid, glycidyl (meth)acrylate, glycidyl allyl ether, (meth)acrylamide, diacetone (meth)acrylamide, N-methylol (meth)acrylamide, N-butoxymethyl (meth)acrylamide, N-methoxymethyl (meth)acrylamide, N,N-dimethylaminoethyl (meth)acrylate, N,N-dimethylaminopropyl (meth)acrylate and the like. This monomer (b-2) is not essential and the amount thereof in the total amount of the three kinds of the monomers (b-1), (b-2) and (b-3) should not exceed 30% by weight. When the amount thereof is too large, the fabric material treated with the fabric finishing agent would be somewhat poor in the feeling of touch though with improvements in the durability of the treated fabric material and adhesion of the coating film to the fiber surface. When the fabric finishing agent of the invention is prepared by the graft copolymerization of the organopolysiloxane and the monomers including this monomer (b-2), advantages are obtained that the adhesion of the coating film to the fiber surface is improved and the fabric material treated with the fabric finishing agent is rendered antistatic and adequately hydrophilic and, in addition, the coating film on the fiber surface is crosslinked by a heat treatment or by the reaction with an optionally added polyfunctional crosslinking agent so that the treated fabric material is imparted with further improved durability and resistance against laundering and dry cleaning.

Another optional monomeric component to be graft-copolymerized with the organopolysiloxane is the component (b-3) which can be any of radical-polymerizable ethylenically unsaturated monomers other than the above described monomeric components (b-1) and (b-2). Examples of the monomers suitable as the component (b-3) include styrene, $\alpha$-methyl styrene, acrylonitrile, vinyl chloride, vinylidene chloride, vinyl acetate, vinyl propionate, vinyl esters of so-called Versatic Acids and the like. When the fabric finishing agent of the invention is prepared by the graft copolymerization of the organopolysiloxane and the monomers including this monomer (b-3), advantages are obtained that the fabric material treated therewith is imparted with further improved durability and adhesion of the coating film to the fiber surface as well as a unique feeling to the touch not obtained with the monomers (b-1) and (b-2) alone. The amount of the monomer (b-3), however, should not exceed 20% by weight based on the total amount of the monomers (b-1), (b-2) and (b-3). When the amount of the monomer (b-3) is too large, the advantageous features obtained by the acrylic monomer (b-1) may be lost more or less.

Thus, the monomeric constituent pertaining to the graft copolymerization with the organopolysiloxane is composed of from at least 70% by weight of the monomer (b-1), up to 30% by weight of the monomer (b-2) and up to 20% by weight of the monomer (b-3). It is important that the grafting moiety formed from these monomers on the organopolysiloxane may have a glass transition point not higher than 0° C. or, preferably, not higher than −10° C. since otherwise the fabric finishing agent comprising the graft copolymer would fail to impart the treated fabric material with a fully soft feeling of touch. This requirement should be taken into consideration in selecting the mixing proportion of the monomeric components (b-1), (b-2) and (b-3) in combination.

The principal ingredient of the inventive fabric finishing agent is a graft copolymer obtained by the graft copolymerization of the above described monomeric component or components on the organopolysiloxane. It is essential that the graft copolymer is composed of from 5 to 95 parts by weight of the organopolysiloxane moiety and from 95 to 5 parts by weight of the grafting moiety. When the proportion of the organopolysiloxane moiety is too small, the fabric finishing agent is defective due to the appearance of stickiness in the fabric material treated therewith as is inherent in acrylic polymers per se as well as a decrease in the softness of feeling of the treated fabric material. When the proportion of the organopolysiloxane moiety is too large, on the other hand, disadvantages are caused due to decrease in the strength of the coating film on the fiber surface, adhesion of the coating film to the surface and durability of the treated fabric material. The graft copolymerization is carried out according to a known procedure of emulsion polymerization, suspension polymerization or solution polymerization. When the process of emulsion polymerization is undertaken for the graft copolymerization, the aqueous emulsion of the organopolysiloxane prepared by the emulsion polymerization can be used as such. When the process of suspension or solution polymerization is undertaken, the organopolysiloxane is suspended or dissolved in the polymerization medium together with the grafting monomer or monomers.

The emulsion polymerization is carried out by adding and emulsifying monomer or monomers in an aqueous emulsion of the organopolysiloxane containing a water-soluble radical polymerization initiator such as potassium persulfate, ammonium persulfate, hydrogen peroxide, azobisamidinopropane hydrochloride and the like together with other optional additives and agitating the emulsion at a temperature of 5 to 80° C. The above mentioned optional additives used according to need include emulsifying agent to improve the stability of the emulsion and to prevent occurrence of coagulum in the course of the polymerization such as anionic surface active agents, e.g., salts of alkyl or alkylaryl sulfates or sulfonates, salts of alkylaryl succinates and the like, non-ionic surface active agents, e.g., polyoxyethylene alkylphenyl ethers, polyoxyethylene alkyl ethers, polyoxyethylene carboxylates and the like, and cationic surface active agents, e.g., alkyl trimethyl ammonium chloride, alkyl benzyl ammonium chloride and the like, chain transfer agents, pH controlling agents and so on.

The suspension polymerization is carried out by adding and dispersing a mixture of the organopolysiloxane and the grafting monomer or monomers in an aqueous medium containing a suspending agent which is a natural or synthetic water-soluble polymer such as polyvinyl alcohol or a derivative thereof, cellulose derivatives, e.g., methyl cellulose, ethyl cellulose and carboxymethyl cellulose, polyethylene glycol and polypropylene glycol or derivatives thereof, gelatine, sodium alginate and the like, monomer-soluble radical polymerization initiator such as tert-butyl hydroperoxide, cumene hydroperoxide, dibutyl peroxide, dibenzoyl peroxide, diisopropyl peroxide, diisopropylperoxy carbonate, cumyl peroxide, azobisisobutyronitrile and the like and other optional additives such as chain transfer agents, pH controlling agents and so on and agitating the suspension at an appropriate polymerization temperature. It is further optional that a reducing agent such as sodium hydrogen sulfite, Rongalite, L-ascorbic acid, saccharide compounds, amines and the like is added to the suspension so that the graft copolymerization is effected by a redox-type polymerization initiator system.

The solution polymerization is carried out by dissolving the organopolysiloxane and the grafting monomer or monomers in a suitable organic solvent together with a radical polymerization initiator and other optional additives such as chain transfer agents and the like and heating the solution with agitation at an appropriate polymerization temperature. Examples of suitable organic solvents include benzene, toluene, xylene, methyl ethyl ketone, methyl isobutyl ketone, ethyl acetate, butyl acetate, ethylene glycol monoalkyl ethers and monoacetates thereof, chlorinated hydrocarbon solvents, dimethyl formamide and the like.

When the graft copolymerization is carried out in a process of emulsion or suspension polymerization, the graft copolymer is separated from the aqueous polymerization medium and dissolved in an organic solvent to give the fabric finishing agent of the invention. When emulsion polymerization is undertaken, particles of the graft copolymer are coagulated by adding an inorganic salt or a water-soluble organic solvent to the polymerization medium to destroy the emulsion and the coagulum is taken by filtration, washed with water and dried before it is dissolved in an organic solvent. When suspension polymerization is undertaken, the polymerization mixture is filtered to collect the particles of the graft copolymer followed by washing with water and drying. When solution polymerization is undertaken, the graft copolymer is obtained already in the form of a solution in an organic solvent so that the polymerization mixture as obtained can be used as the fabric finishing agent of the invention. The organic solvent used for dissolving the graft copolymer obtained by the emulsion or suspension polymerization can be any of those given as the examples of the organic solvent usable in the solution polymerization. The viscosity of the thus prepared solution of the graft copolymer as the inventive fabric finishing agent is not particularly limitative but it is usually in the range from 100 to 100,000 centipoise in order to have good workability in the treatment of a fabric material therewith. The solution contains the graft copolymer in a concentration in the range from 5 to 30% by weight or, preferably, from 10 to 25% by weight for an economical reason and with an object to keep a working time required for the treatment of a fabric material therewith.

When a fabric material is treated with the thus prepared fabric finishing agent of the invention, the fabric material is imparted with a soft but non-sticky feeling of touch with resilient elasticity and the effect is durable and highly resistant against laundering and dry cleaning. It is preferable that the inventive fabric finishing agent is further admixed with a crosslinking agent, which is not effective in a solution at room temperature but effective in the process of drying and heating treatment, as combined with a crosslinking catalyst so that the above mentioned effect of improvement can further be enhanced.

The crosslinking agent suitable for the purpose is preferably a compound having at least two functional groups in a molecule. Examples of such a polyfunctional compound suitable as the crosslinking agent include polyisocyanate compounds such as difunctional isocyanate compounds, e.g., tolylene diisocyanate, diphenyl methane diisocyanate and hexane diisocyanate, trifunctional isocyanate compounds, e.g., those commercial product sold under the trade names of Coronate L by Nippon Polyurethane Industry Co. and Desmodur by Bayer Co., and urethane polymers having isocyanate groups at the molecular chain ends, polyhydroxy compounds such as propylene glycol, polypropylene glycol, butane diol, polyester resins having a high hydroxyl value and copolymers of a hydroxyalkyl (meth)acrylate and a vinyl monomer, polycarboxyl compounds such as phthalic anhydride, adipic acid, polyester resins having a high acid value and copolymers of (meth)acrylic acid and a vinyl monomer, polyoxirane compounds such as 1,6-hexane diol diglycidyl ether, polypropylene glycol diglycidyl ether, trimethylol propane triglycidyl ether and epoxy resins, polymethylol compounds such as phenolic resins, alcohol-modified phenolic resins and ketone resins, amino resins, such as copolymers of N-methylol (meth)acrylamide and a vinyl monomer, and polyamino compounds such as triethylene tetramide, ether amino resins and 2,2-bishydroxymethylbutanol-tris[3-(1-aziridinyl)propionate], among which the above mentioned polyisocyanate compounds are particularly preferable. These crosslinking agents should desirably be soluble in an organic solvent. The amount of the crosslinking agent should not exceed 30 parts by weight per 100 parts by weight of the graft copolymer in the inventive fabric finishing agent. Addition of a too large amount of the crosslinking agent is undesirable because of the adverse influence on the feeling of the fabric material treated with the fabric finishing agent to decrease the softness in addition to the decrease in the pot life of the fabric finishing agent as prepared.

No crosslinking catalyst is usually needed when a polyisocyanate compound is used as the crosslinking agent. It is preferable, however, that the crosslinking agent of other types is used in combination with a crosslinking catalyst which may be any of known ones depending on the type of the crosslinking agent. Examples of crosslinking catalysts include organic acids, acid anhydrides, amine compounds, organotin compounds, titanium alcoholates, aluminum alcoholates and the like. The amount of the crosslinking catalyst in the inventive fabric finishing agent should not exceed 10 parts by weight per 100 parts by weight of the graft copolymer as the principal ingredient. Addition of a too large amount of the crosslinking catalyst is undesirable because of the decrease in the pot life of the fabric finishing agent and adverse influences on the feeling of the fabric material treated therewith as well as the problem due to the toxicity of some of the above named crosslinking catalysts.

Any known method is applicable to the treatment of a fabric material with the inventive fabric finishing agent. For example, a fabric material such as woven cloths, knit cloths, non-woven fabrics and the like is coated with the fabric finishing agent by using a suitable coating machine such as knife coaters, roll coaters, gravure roll coaters, kiss coaters and the like or by spraying. Alternatively, the fabric material can be soaked with the fabric finishing agent by dipping therein followed by squeezing to control the amount of the solution picked up by the fabric material. Though dependent on the particular application of the fabric material treated with the inventive fabric finishing agent, the coating amount of a fabric material therewith is usually in the range from 1 to 100 g or, preferably, from 1 to 30 g calculated for the amount of the graft copolymer per $m^2$ of the fabric material so that the treated fabric material is imparted with a pleasant feeling of touch. The fabric material coated or soaked with the fabric finishing agent is then dried by heating by which crosslinking reaction of the graft copolymer proceeds. Heating is performed usually at a temperature of 80 to 180° C. for 0.5 to 10 minutes. When a single treatment as described above cannot give a sufficiently large coating amount on the fiber surface, the coating treatment can be repeated as many times as desired to increase the coating amount since the coating film once formed on the fiber surface is not affected by subsequent contacting with the fabric finishing agent in the form of a solution in an organic solvent. It is also possible that the treatment with the inventive fabric finishing agent is preceded or succeeded by a treatment with a fabric finishing agent of different types.

By virtue of the uniqueness of the principal ingredient which is a graft copolymer of an organopolysiloxane having radical polymerizable groups or mercapto-containing organic groups and the specific grafting monomer or monomers, the fabric finishing agent of the invention can give a fabric material exhibiting a soft but non-sticky and crisp feeling with resilient elasticity and having excellent water repellency, waterproofness and moisture permeability and the thus obtained fabric material is highly durable and resistant against laundering and dry cleaning, especially, when the fabric finishing agent is formulated with a crosslinking agent.

The fabric material obtained by the treatment with the inventive fabric finishing agent is free from yellowing in the lapse of time and has excellent weatherability and crease resistance along with improved workability in sewing. Accordingly, the inventive fabric finishing agent is useful in the treatment of various kinds of clothing items required to be waterproof and windproof such as sportswears, raincoats, skiwears and the like and various kinds of industrial fabric materials such as cloths for umbrellas and tents, automobile hoods, waterproof sheets for construction works and and like.

In the following, the inventive fabric finishing agent is described in more detail by way of examples describing preparation of the fabric finishing agents and application thereof to the finishing treatment of fabric materials. The term of "parts " in the following description always refers to "parts by weight".

PREPARATION EXAMPLE 1

A base emulsion was prepared by agitating a mixture of 1500 g of octamethyl cyclotetrasiloxane, 1.1 g of 3-methacryloxypropyl methyl siloxane and 1500 g of water with addition of 15 g of sodium lauryl sulfate and 10 g of dodecylbenzene sulfonic acid by using a homomixer and the base emulsion was passed twice through a homogenizer to give a stable emulsion. This emulsion was introduced into a flask and heated at 70° C. for 12 hours followed by cooling to room temperature and neutralization with sodium carbonate to have a pH of 7. Thereafter, nitrogen gas was bubbled into the emulsion for 4 hours and then the emulsion was freed from volatile siloxanes by steam distillation followed by adjustment of the content of non-volatile matter of 45% with addition of water to give an aqueous emulsion of an organopolysiloxane of which the content of the 3-methacryloxypropyl groups was 0.03% by moles based on the overall amount of the silicon-bonded organic groups. This emulsion is referred to as E-1 hereinbelow.

Three more aqueous emulsion, referred to as E-2, E-3 and E-4 hereinbelow, were prepared each in substantially the same manner as above excepting replacement of 1.1 g of 3-methacryloxypropyl methyl siloxane with 3.9 g of the same siloxane, 3.8 g of 3-acryloxypropyl methyl siloxane and 56.3 g of 3-mercaptopropyl methyl siloxane, respectively. The contents of the 3-methacryloxypropyl groups, 3-acryloxypropyl groups and 3-mercaptopropyl groups in the organopolysiloxanes of the emulsions E-2, E-3 and E-4 were 0.1% by moles, 0.1% by moles and 2.0% by moles, respectively, based on the overall amount of the silicon-bonded organic groups.

PREPARATION EXAMPLE 2

Into a three-necked flask of 3 liter capacity equipped with a stirrer, reflux condenser, thermometer and nitrogen gas inlet were introduced 477 g of the emulsion E-1 prepared above containing 214.5 g of the organopolysiloxane and 1400 g of water and, after cooling of the emulsion to 10° C. under a stream of nitrogen gas, the emulsion was admixed with 0.4 g of tert-butyl hydroperoxide, 2.0 g of L-ascorbic acid and 0.008 g of iron (II) sulfate heptahydrate and then a monomer mixture composed of 247.5 g of ethyl acrylate, 247.5 g of butyl acrylate and 5 g of 2-hydroxyethyl methacrylate was added to the emulsion dropwise over a period of 3 hours followed by further continued agitation of the mixture for additional 1 hour to complete the copolymerization reaction. The thus obtained emulsion contained 30.0% of the graft copolymer. The above mentioned formulation of the three kinds of the grafting monomers was selected in consideration of the glass transition temperature −38.5° C. of the copolymer to be obtained when the three monomers alone were copolymerized.

In the next place, 1000 g of the thus obtained emulsion were introduced into a flask of 5 liter capacity equipped with a stirrer and heated at 60° C. followed by the addition of an aqueous solution of 92 g of sodium sulfate in 563 g of water to precipitate the graft copolymer which was repeatedly filtered and washed with water and finally dried at 60° C. to give an acrylic-grafted organopolysiloxane referred to as P-1 hereinbelow.

Four more acrylic-grafted organopolysiloxanes, referred to as P-2, P-3, P-4 and P-5 hereinbelow, were prepared in substantially the same manner as above. The organopolysiloxane emulsions used here were E-1, E-2, E-3 and E-4 for P-2 to P-5, respectively, each in the same amount as E-1 used in the preparation of P-1. The combination of the grafting monomers was modified as shown in Table 1 below which also shows the weight ratio of the organopolysiloxane to the grafting monomers and the calculated glass transition temperature of the copolymer to be obtained when the mixture of the monomers alone was copolymerized.

TABLE 1

| | P-2 | P-3 | P-4 | P-5 |
|---|---|---|---|---|
| Methyl acrylate, g | 105.1 | — | — | — |
| Ethyl acrylate, g | — | 247.5 | 252.5 | 150.2 |
| Butyl acrylate, g | 105.1 | 247.5 | 187.5 | 49.3 |
| 2-Methoxyethyl acrylate, g | — | — | 45.0 | — |

TABLE 1-continued

| | P-2 | P-3 | P-4 | P-5 |
|---|---|---|---|---|
| Methacrylic acid, g | — | — | 15.0 | — |
| M-methylol acrylamide, g | — | 5.0 | — | 4.3 |
| Glycidyl methacrylate, g | 4.3 | — | — | — |
| Acrylonitrile, g | — | — | — | 10.7 |
| Total of monomers, g | 214.5 | 500.0 | 500.0 | 214.5 |
| Weight ratio of [organopolysiloxane]:[grafting monomers] | 5:5 | 3:7 | 3:7 | 5:5 |
| Glass transition temp., °C., of graft moiety, calculated | −25.5 | −38.3 | −11.9 | −24.9 |

PREPARATION EXAMPLE 3

Into a hermetically sealable stainless steel-made vessel of 500 ml capacity equipped with a stirrer were introduced 264 g of toluene and then 36 g of the acrylic-grafted organopolysiloxane P-1 were added to the toluene in the vessel under agitation and dissolved therein at 60° C. with continued agitation to give a clear solution, which is referred to as the solution S-1 hereinbelow, containing 12% by weight of the grafted organopolysiloxane. Similarly, the acrylic-grafted organopolysiloxanes P-2 to P-5 were each dissolved in toluene to give toluene solutions, which are referred to as the solutions S-2 to S-5, respectively, hereinbelow.

PREPARATION EXAMPLE 4

The organopolysiloxane emulsion E-2 in an amount of 500 g was admixed with 500 g of methyl alcohol to precipitate the organopolysiloxane which was washed three times each with 500 g of methyl alcohol and dried by heating at 105° C. for 3 hours.

Into a three-necked flask of 2 liter capacity equipped with a stirrer, reflux condenser, thermometer and nitrogen gas inlet were introduced 108 g of the above prepared dry organopolysiloxane and 840 g of toluene and the mixture was heated at 50° C. under a stream of nitrogen gas with agitation so as to dissolve the organopolysiloxane in toluene. The solution was admixed with 3.6 g of dibenzoyl peroxide and then a monomer mixture composed of 176.4 g of ethyl acrylate, 70.6 g of butyl acrylate and 5.0 g of 2-hydroxyethyl methacrylate was continuously added thereto dropwise over a period of 5 hours followed by aging for 2 hours after completion of the dropwise addition of the monomer mixture. The thus obtained toluene solution, referred to as the solution S-6 hereinbelow, contained 30% by weight of the acrylic-grafted organopolysiloxane.

EXAMPLES 1 TO 6 AND COMPARATIVE EXAMPLES 1 AND 2

In Examples 1 to 6, 100 parts of one of the toluene solutions S-1 to S-6, respectively, of the acrylic-grafted organopolysiloxanes were admixed with a polyisocyanate compound as a crosslinking agent (Coronate L, a product by Nippon Polyurethane Co.) in an amount indicated in Table 2 below to give a fabric-treatment solution. A nylon taffeta cloth of 70 denier and 210 count was coated with the solution using a knife coater in a coating amount of 33 g/m$^2$, dried at 80° C. for 2 minutes in a hot-air circulation oven and then subjected to a heat treatment at 150° C. for 2 minutes. The cloths treated in this manner were evaluated for the feeling of touch and other properties to find that all of the cloths had excellent feeling, waterproofness, moisture permeability, water repellency and resistance against laundering as is shown in Table 2. The feeling evaluated by organoleptic tests was recorded in four ratings of E for excellent, G for good, F for fair and P for poor feeling.

For comparison, the same nylon taffeta cloth was treated with a commercially available acrylic fabric finishing agent (Toacron SA-110S, a product by Toa Paint Co.) (Comparative Example 1) or a commercially available urethane-based fabric finishing agent (Hilac 5010T, a product by Toyo Polymer Co.) (Comparative Example 2) in the same manner as above to give the results shown in Table 2. The results were apparently inferior as compared with Examples 1 to 6.

TABLE 2

| | Example | | | | | | Comparative Example | |
|---|---|---|---|---|---|---|---|---|
| | 1 | 2 | 3 | 4 | 5 | 6 | 1 | 2 |
| Polyisocyanate, parts | 1.3 | 2.6 | 1.3 | 2.0 | 2.5 | 2.6 | 2.6 | 2.0 |
| Feeling[1] | | | | | | | | |
| Softness | E | E | E | G | E | E | P | P |
| Non-tackiness | E | E | E | E | E | G | P | F |
| Crispness | E | G | E | E | G | G | P | P |
| Resilient elasticity | G | E | G | E | E | G | P | P |
| Water proofness[2] | | | | | | | | |
| As treated | 740 | 620 | 760 | 720 | 680 | 780 | 1080 | >2000 |
| After 5 times laundering[5] | 210 | 260 | 220 | 250 | 280 | 220 | 50 | 0 |
| Moisture permeability | | | | | | | | |
| As treated | 1600 | 1750 | 1550 | 1500 | 1400 | 1300 | 800 | 590 |
| After 5 times laudering[5] | 2000 | 2200 | 2100 | 2300 | 2250 | 1900 | 1500 | 1200 |
| Water repellency[4] | | | | | | | | |
| As treated | 90 | 100 | 90 | 90 | 100 | 90 | 70 | 70 |
| After 5 times dry cleaning | 90 | 100 | 90 | 90 | 100 | 90 | 70 | 70 |

[1]Feeling: organoleptic test
[2]Water proofness, mm: JIS L 1092
[3]Moisture permeability, g/m$^2$, 24 hours: JIS Z 0208
[4]Water repellency, %: JIS L 1092
[5]Laundering: household washing machine, 2 g detergent/liter, bath ratio 1:20, 10 minutes at 40° C.

A twill-woven polyester cloth was treated with the above prepared fabric-treatment solutions in the same manner as above to find that the cloths treated with the solutions of Examples 1 to 6 had a soft but non-tacky feeling with crispness and resilient elasticity as compared with the solutions used in Comparative Examples 1 to 2. This improvement in the feeling was resistant against and retained after dry cleaning.

EXAMPLE 7

The same treatment as in Example 1 was undertaken except that the solvent in the fabric-treatment solution was methyl ethyl ketone instead of toluene. The thus treated nylon taffeta cloth exhibited a feeling and water repellency as satisfactory as in Example 1.

EXAMPLE 8

The fabric-treatment solution was the same as in Example 5 excepting omission of the crosslinking agent. A mixed-spun cloth of polyester and wool was coated with the solution in the same manner as in Example 5 followed by a heat treatment at 150° C. for 3 minutes. The thus treated cloth exhibited excellent feeling and water repellency.

EXAMPLE 9

A fabric-treatment solution was prepared by mixing equal amounts of the toluene solutions S-3 and S-4 without addition of the crosslinking agent. A 35:65 mixed-spun broadcloth of cotton and polyester was coated with the solution and subjected to a heat treatment at 150° C. for 3 minutes. The thus treated cloth exhibited satisfactory feeling and water repellency.

What is claimed is:

1. A fabric finishing agent in the form of a solution in:

(A) a volatile inert organic solvent of (B) a graft copolymer product of a graft copolymerization of from 5 to 95 parts by weight of (a) an organopolysiloxane represented by the general formula $$xo—(—SiR_2—O—)_m—(—SiYR—O—)_n—X,$$

in which each R is a substituted or unsubstituted monovalent hydrocarbon group of 1 to 20 carbon atoms, Y is a monovalent radical-polymerizable group or a monovalent organic group having a mercapto —SH group, X is a hydrogen atom, lower alkyl group or triorganosilyl group of the formula $R_2R^1Si$—, R having the same meaning as defined above and $R^1$ being R or Y, m is a positive integer not exceeding 10,000 and n is a positive integer, and from 95 to 5 parts by weight of (b) an acrylic or methacrylic monomer represented by the general formula $$CH_2=CR^2—CO—OR^3,$$

in which $R^2$ is a hydrogen atom or a methyl group and $R^3$ is an alkyl group or an alkoxy-substituted alkyl group having 1 to 18 carbon atoms, alone or as a mixture of monomers (b-1) at least 70% by weight of which is an acrylic or methacrylic monomer (b) as defined above, and one or both of (b-2) up to 30% by weight of which is an ethylenically unsaturated monomer containing one and only one radical-polymerizable ethylenically unsaturated group and at least one functional group in the molecule selected from the group consisting of hydroxy, hydroxy-terminated polyoxyalkylene, carboxyl, oxirane, amido, N-alkylolamido, N-(alkoxyalkyl)amino and amino groups and (b-3) up to 20% by weight of which is another radical-polymerizable ethylenically unsaturated monomer different from monomers (b-1) and (b-2) defined above, in the presence of a radical polymerization initiator and dissolved in component (A).

2. The fabric finishing agent as claimed in claim 1 which further comprises an organic crosslinking agent having at least two functional groups selected from the group consisting of isocyanate, hydroxyl, methylol, carboxyl, oxirane, amido, alkylolamido, alkoxyalkylamido, amino and aziridine groups and a crosslinking catalyst.

3. The fabric finishing agent as claimed in claim 1 wherein the graft copolymer (B) is the product of the graft polymerization of (a) and the mixture of monomer (b-1) and one or both of monomers (b-2) and (b-3).

4. The fabric finishing agent as claimed in claim 1 wherein the acrylic or methacrylic monomer (b-1) is selected from the group consisting of methyl (meth)acrylate, ethyl (meth)acrylate, butyl (meth)acrylate, pentyl (meth)acrylate, hexyl (meth)acrylate, 2-ethylhexyl (meth)acrylate, octyl (meth)acrylate, 2-methoxyethyl (meth)acrylate and 2-butoxyethyl (meth)acrylate.

5. The fabric finishing agent as claimed in claim 1 wherein monomer (b-2) is selected from the group consisting of 2-hydroxyethyl (meth)acrylate, 2-hydroxypropyl (meth)acrylate, polyethylene glycol mono(meth)acrylate, polypropylene glycol mono(meth)acrylate, (meth)acrylic acid, crotonic acid, half esters of maleic acid, glycidyl (meth)acrylate, glycidyl allyl ether, (meth)acrylamide, diacetone (meth)acrylamide, N-methylol (meth)acrylamide, N-butoxymethyl (meth)acrylamide, N-methoxymethyl (meth)acrylamide, N,N,-dimethylaminoethyl (meth)acrylate and N,N-dimethylaminopropyl (meth)acrylate.

6. The fabric finishing agent as claimed in claim 1 wherein monomer (b-3) is selected from the group consisting of styrene, α-methyl styrene, acrylonitrile, vinyl chloride, vinylidene chloride, vinyl acetate, vinyl propionate and vinyl esters of Versatic Acids.

7. The fabric finishing agent as claimed in claim 2 wherein the crosslinking agent is a polyisocyanate compound.

8. The fabric finishing agent as claimed in claim 3, wherein the graft polymer (B) has a glass transition point not higher than 0° C.

9. The fabric finishing agent as claimed in claim 3, wherein the graft polymer is a product of a graft polymerization of (a) and a mixture of monomers wherein (b-1) is selected from the group consisting of methyl (meth)acrylate, ethyl (meth)acrylate, butyl (meth)acrylate, pentyl (meth)acrylate, hexyl (meth)acrylate, 2-ethylhexyl (meth)acrylate, octyl (meth)acrylate, 2-methoxyethyl (meth)acrylate and 2-butoxyethyl (meth)acrylate, a mixture of monomers wherein (b-2) is selected from the group consisting of 2-hydroxyethyl (meth)acrylate, 2-hydroxypropyl (meth)acrylate, polyethylene glycol mono(meth)acrylate, polypropylene glycol mono(meth)acrylate, (meth)acrylic acid, crotonic acid, half esters of maleic acid, glycidyl (meth)acrylate, glycidyl allyl ether, (meth)acrylamide, diacetone (meth)acrylamine, N-methylol (meth)acrylamide, N-butoxymethyl (meth)acrylamide, N-methoxymethyl (meth)acrylamide, N,N-dimethylaminoethyl (meth)acrylate and N,N-dimethylaminopropyl (meth)acrylate, and a mixture of monomers wherein (b-3) is selected from the group consisting of styrene, α-methyl styrene, acrylonitrile, vinyl chloride, vinylidene chloride, vinyl acetate, vinyl propionate and vinyl esters of Versatic Acids.

10. The fabric finishing agent as claimed in claim 3, wherein the mixture of monomers comprises butyl acrylate and methyl acrylate or ethyl acrylate (b-1).

11. The fabric finishing agent as claimed in claim 9, wherein the organic solvent is selected from the group consisting of benzene, toluene, xylene, methyl ethyl ketone, methyl isobutyl ketone, ethyl acetate, butyl acetate, ethylene glycol monoalkyl ethers, and monoacetates thereof.

* * * * *